US006763612B2

(12) United States Patent
Stubblefield et al.

(10) Patent No.: US 6,763,612 B2
(45) Date of Patent: Jul. 20, 2004

(54) SUPPORT STRUCTURE FOR A SHOE

(75) Inventors: Jerry Stubblefield, Lake Oswego, OR (US); Tuan N. Le, Portland, OR (US); Thomas Austin, Nashua, NH (US); Robert L. Peterson, West Linn, OR (US)

(73) Assignee: BMC Players, Wilmington, DE (US)

( * ) Notice: Subject to any disclaimer, the term of this patent is extended or adjusted under 35 U.S.C. 154(b) by 0 days.

(21) Appl. No.: 10/193,369

(22) Filed: Jul. 10, 2002

(65) Prior Publication Data

US 2003/0009912 A1 Jan. 16, 2003

Related U.S. Application Data

(63) Continuation-in-part of application No. 09/897,631, filed on Jul. 2, 2001, now Pat. No. 6,589,614.
(60) Provisional application No. 60/226,451, filed on Aug. 17, 2000.

(51) Int. Cl.[7] ..... A43B 13/20
(52) U.S. Cl. ..... 36/29; 36/35 R
(58) Field of Search ..... 36/29, 28, 35 R, 36/153

(56) References Cited

U.S. PATENT DOCUMENTS 4,183,156 A 1/1980 Rudy et al.
4,462,171 A * 7/1984 Whispell ..... 36/3 B
5,092,060 A * 3/1992 Frachey et al. ..... 36/29
5,224,278 A * 7/1993 Jeon ..... 36/29
5,353,459 A 10/1994 Potter et al.
5,575,088 A 11/1996 Allen et al.
5,595,004 A * 1/1997 Lyden et al. ..... 36/29
6,098,313 A * 8/2000 Skaja ..... 36/28
6,354,020 B1 * 3/2002 Kimball et al. ..... 36/29
6,457,262 B1 * 10/2002 Swigart ..... 36/29
6,589,614 B2 * 7/2003 Stubblefield et al. ..... 36/29
6,598,320 B2 * 7/2003 Turner et al. ..... 36/28

* cited by examiner

*Primary Examiner*—Ted Kavanaugh
(74) *Attorney, Agent, or Firm*—Kenyon & Kenyon

(57) ABSTRACT

A support structure for a shoe includes a bladder arrangement having at least one (and preferably two) fluid-filled chamber arranged in a heel region of the sole of the shoe. The fluid-filled chamber has outer walls with a pressurized fluid disposed therein. The fluid-filled chamber is configured to be compressively deformed when an external pressure is applied thereto, such as the pressure exerted by a wearer's foot. The support structure also includes at least one pillar disposed in the fluid-filled chamber. The pillars are configured to decrease the amount by which the fluid-filled chamber is compressively deformed when the external pressure is applied thereto, while still permitting the fluid-filled chambers to be deformed sufficiently to provide-adequate protection against the force of impact during use.

20 Claims, 4 Drawing Sheets

SUPPORT STRUCTURE FOR A SHOE

RELATED APPLICATIONS

The present application is a continuation-in-part of U.S. patent application Ser. No. 09/897,631, filed on Jul. 2, 2001 now U.S. Pat. No. 6,589,614, which claims the benefit of priority to U.S. Provisional Patent Application Serial No. 60/226,451, filed on Aug. 17, 2000, both of which are incorporated by reference herein as fully as if set forth in their entirety.

FIELD OF THE INVENTION

The present invention relates to support structure for a shoe and, more particularly, to a bladder arrangement comprising fluid filled chambers having support pillars that provides additional stability to the shoe.

BACKGROUND OF THE INVENTION

The human foot and leg endures a great deal of stress, even during the performance of simple activities like walking. More rigorous activities, such as running and jumping, subject a person's feet and legs to even greater stress. This is particularly true of athletes, many of whom perform such rigorous activities on a daily basis.

In order to alleviate the unusually high levels of stress imparted on an athlete's feet and legs, athletic shoes are typically designed to absorb the force of impact associated with running and jumping. Specifically, athletic shoes often include supporting and cushioning structures to absorb these forces of impact. These supporting and cushioning structures are typically positioned in the rear foot or heel section of the shoe where the forces of impact are most likely to be experienced. Many athletic shoes also provide supporting and cushioning structures on the sides of the shoe, not merely in the region of the heel. These supporting and cushioning side structures absorb the force of impact along the sides of the athlete's foot.

Currently, there are many configurations for these supporting and cushioning structures. Some of these configurations include the use of fluid-filled chambers. A fluid-filled chamber typically comprises a fluid-filled chamber or pocket located in the sole of an athletic shoe. The fluid may be air or else any other type of gas or liquid that is deemed to provide the desired level of stability. Depending on the amount of support desired, the fluid-filled chambers may be maintained at the ambient pressure, may be pressurized beyond the ambient pressure level, or else may be de-pressurized below the ambient pressure level.

U.S. Pat. No. 5,575,088 discloses a fluid-filled bladder arrangement imparting cushioning to a heel section of a shoe. The bladder arrangement includes individual, concentric chambers that are connected so as to allow fluid to be communicated between the chambers. The concentric chambers are ring-shaped with the inner ring having a lower height than the outer ring. The arrangement forms a cradle for the heel, providing support and stabilization therefor. The pressure within the chambers of the bladder is uniform because fluid pressure is equalized between the ring sections, which are in fluid communication with one another.

U.S. Pat. No. 5,353,459 to Potter et al. discloses a bladder arrangement in which separate chambers are maintained at different pressures through the use of distinct interconnecting tubes. Specifically, Potter discloses a bladder arrangement having tube-shaped chambers that are disposed at and form the lateral and medial sides of the bladder, a rear central chamber disposed between these tube-shaped chambers at one end thereof, and a front central chamber disposed between these tube-shaped chambers at another end thereof. When disposed within a shoe, the rear central chamber of the bladder arrangement provides support to the heel of the wearer, the front central chamber provides support to the middle of the wearer's foot, and the two tube-shaped chambers provide support to the medial and lateral sides of the wearer's foot.

One problem that is experienced by the use of fluid-filled chambers as supporting and cushioning structures in shoes is that, due to their compressibility, the fluid-filled chambers may not provide the desired amount of support and stability. For example, in addition to the impact forces that are experienced by the feet and legs of an athlete, many sports require an athlete to rapidly change his or her direction of motion. Still other sports require an athlete to place his or her foot on a field or playing surface which is not perfectly flat. Both of these situations may result in the athlete's foot undesirably rotating relative to the athlete's leg. This may result in the athlete performing inadequately, e.g., failing to execute a desired movement. In addition, if the athlete's foot rotates too far relative to the athlete's leg, the athlete may suffer an injury. For instance, if the inner (e.g., medial) side of the foot is rotated downwardly too far relative to the outer (e.g., lateral) side of the foot, the foot may be over-pronated and an injury may occur. Likewise, if the medial side of the foot is rotated upwardly too far relative to the lateral side of the foot, the foot may be over-supinated and an injury may also occur. Of course, these are merely two types of excessive rotations that can cause foot injuries.

Thus, while fluid-filled chambers may provide adequate protection against impact forces, they may not provide adequate stability if they deform too much when they are compressed. For instance, even though a fluid-filled chamber may be pressurized, the fluid-filled chamber may not be able to provide an adequate amount of support to stabilize the foot of a large athlete. In addition, the fluid-filled chamber may not be able to provide an adequate amount of support to stabilize the foot of an athlete that participates in a sport that requires rapid changes in direction, e.g., basketball, even if it is able to provide an adequate amount of support to stabilize the foot of an athlete that participates in a sport that does not require these movements, e.g., marathon running. If the amount of support provided by the fluid-filled chamber is inadequate, the athlete may not receive the support need to perform optimally, or else may risk injury when the athlete's foot undesirably rotates relative to the athlete's leg.

SUMMARY OF THE INVENTION

The present invention, in accordance with one embodiment thereof, relates to a support structure for a shoe. The support structure comprises a bladder arrangement including at least one (and preferably two) fluid-filled chamber arranged in a sole of the shoe. The fluid-filled chamber has outer walls with a fluid disposed therein. Preferably, the fluid is pressurized. The fluid-filled chamber is configured to be compressively deformed when an external pressure is applied thereto, such as the pressure exerted by a wearer's foot.

The support structure also includes at least one pillar disposed in the fluid-filled chamber. The pillars are configured to decrease the amount by which the fluid-filled chamber is compressively deformed when the external pressure is applied thereto. Preferably, the pillars are configured such that, although they decrease the amount by which the fluid-filled chamber is compressively deformed when the external pressure is applied thereto, they do permit the fluid-filled chambers to be deformed sufficiently to provide adequate protection against the force of impact during use. Advantageously, the pillar has a tapered shape, such that it tapers from a first, e.g., larger, dimension at its connection to the outer walls of the fluid-filled chamber to a second, e.g., smaller, dimension at a point between the outer walls of the fluid-filled chamber, so as to provide a desirable amount of structural rigidity.

In a preferred embodiment, the bladder arrangement of the support structure includes two fluid-filled chambers, each of which are positioned along a medial side and a lateral side of the heel region of the shoe. The fluid-filled chambers are preferably encapsulated by a cushioning material such as polyurethane foam.

DETAILED DESCRIPTION OF THE INVENTION

Figure 1:
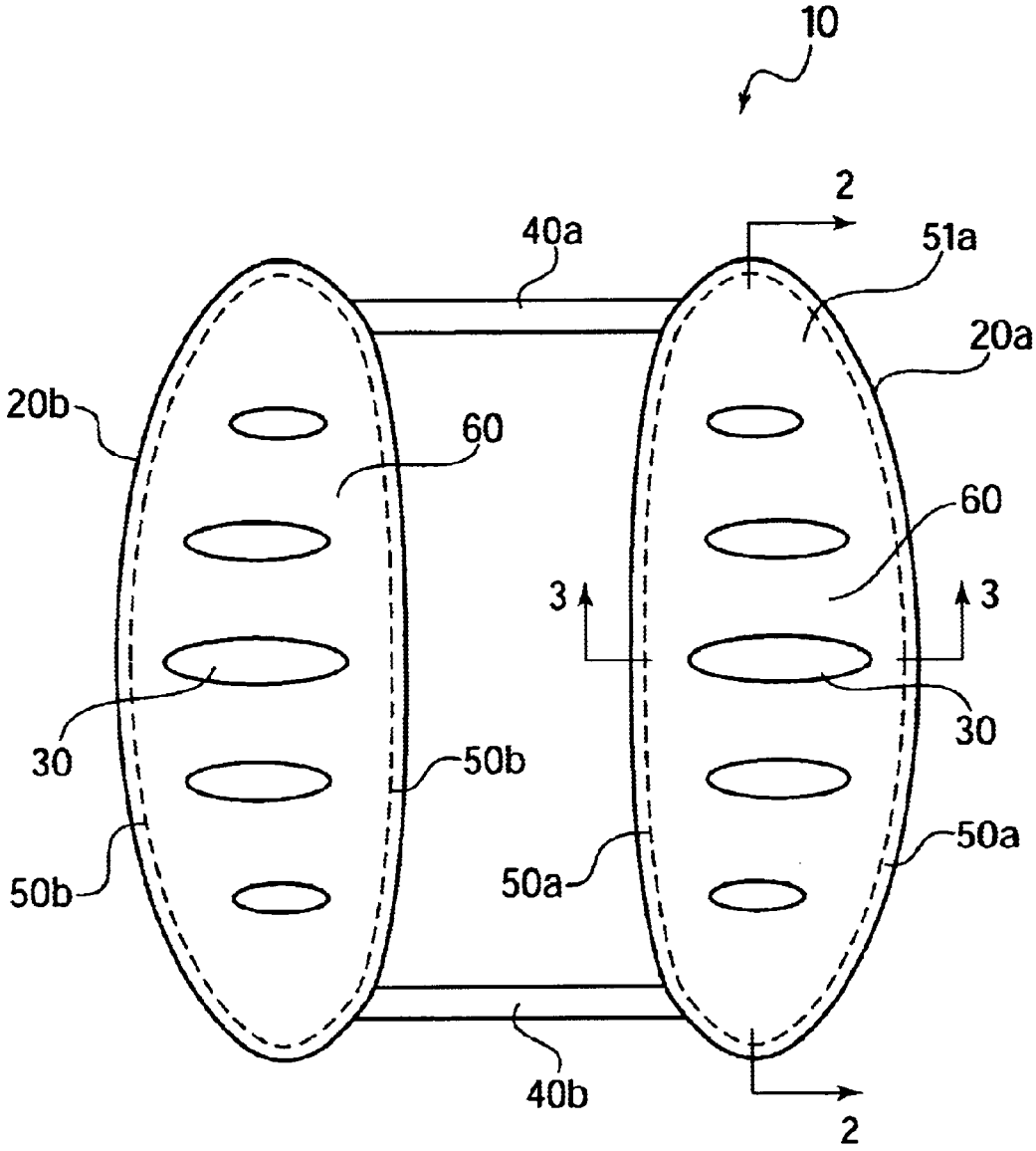
FIG. 1 is a top view of a bladder arrangement having pillar-supported fluid-filled chambers, according to one example embodiment of the present invention.

FIG. 1 illustrates a support structure 10 wherein a bladder arrangement comprises pillar-supported fluid-filled chambers, in accordance with one example embodiment of the present invention. The embodiment illustrated in FIG. 1 is configured to be located in the heel region of a shoe, which may be an athletic shoe (it is recognized that, while the term "athletic shoe" is often used herein, the employment of a bladder arrangement having pillar-supported fluid-filled chambers in accordance with the present invention may be used in any type of shoe worn by any type of wearer, and is not intended to be limited to merely "athletic shoes" nor to shoes worn by "athletes"). More specifically, FIG. 1 illustrates a support structure 10 wherein a bladder arrangement includes a pair of fluid-filled chambers 20*a* and 20*b*. When incorporated into a shoe (see FIGS. 4 and 5, which are explained in greater detail below), each fluid-filled chamber 20 is located on lateral sides of the wearer's heel. Thus, for example, if the support structure 10 illustrated in FIG. 1 is incorporated into a shoe to be worn on a wearer's right foot, the fluid-filled chamber 20*a* may support the lateral side of the wearer's right foot, while the fluid-filled chamber 20*b* may support the medial side of the wearer's right foot. This arrangement is best illustrated in FIG. 5. Likewise, if the support structure 10 illustrated in FIG. 1 is incorporated into a shoe to be worn on a wearer's left foot, the fluid-filled chamber 20*a* may support the medial side of the wearer's left foot, while the fluid-filled chamber 20*b* may support the lateral side of the wearer's left foot.

Each fluid-filled chamber 20*a* and 20*b* comprises a sealed chamber that is preferably filled with a pressurized fluid 60. The fluid-filled chambers 20*a* and 20*b* are defined by outer walls 50*a* and 50*b*, respectively. Outer walls 50*a* and 50*b* are preferably comprised of an elastomeric material such as a thermoplastic polyurethane elastomer (TPU). Other suitable materials include, by way of non-limiting example, polyester, poly(ethyleneco-vinyl acetate) (EVA), polyethylene, propylene, neoprene and rubber. Materials that have been found to be particularly useful in the manufacture of the bladder arrangement of the present invention are materials with a shore "A" durometer hardness in the range of approximately 85 to approximately 95 and, more preferably, in the range of 87 to 93. The outer walls 50*a* and 50*b* of the fluid-filled chambers 20*a* and 20*b* preferably have a thickness of approximately 0.5 mm to approximately 2.5 mm, and is advantageously about 1.2 mm. The fluid-filled chambers 20*a* and 20*b* may be manufactured by various methods known in the art such as a two-film technique or blow-molding.

The pressure in each fluid-filled chamber 20*a* and 20*b* may vary according to the desired amount of support, but is typically in the range of 5 to 20 pounds per square inch (psi), and is preferably 15 psi. In accordance with alternative embodiments of the invention, the fluid pressure in fluid-filled chamber 20*a* may be greater than the fluid pressure in fluid-filled chamber 20*b*, or vice versa, in order to provide additional protection against certain types of motion, e.g., pronation or supination.

A preferred type of fluid 60 which may be employed is nitrogen gas ($N_2$). Various other gases may be utilized such as air, hexafluorethane or sulfur hexafluoride. Other suitable gases include those disclosed in U.S. Pat. No. 4,183,156, which is incorporated herein by reference. Advantageously, the gas selected has a low diffusion rate through the outer walls 50*a* and 50*b* of the fluid-filled chambers 20*a* and 20*b* to ensure that the fluid-filled chambers 20*a* and 20*ba* function satisfactorily for a desired useful life. It is also noted that a liquid, gel or polymeric foam may be utilized as the fluid 60.

FIG. 1 also illustrates connective elements 40*a* and 40*b* which connect the fluid-filled chambers 20*a* and 20*b*. The connective elements 40*a* and 40*b* are preferably comprised of the same material as the outer walls 50*a* and 50*b*. The connective elements 40*a* and 40*b* may-facilitate the molding of the bladder arrangement. Further, the connective elements 40*a* and 40*b* may facilitate the positioning of the bladder arrangement within a shoe.

Each of the fluid-filled chambers 20*a* and 20*b* include pillars 30. In the embodiment illustrated, each of the fluid-filled chambers 20*a* and 20*b* include five pillars 30, although any number of pillars may be employed. Furthermore, it is noted that, although an equal number of pillars 30 are illustrated in each of the fluid-filled chambers 20*a* and 20*b*, it is contemplated that an unequal number of pillars may be employed in each of the fluid-filled chambers 20*a* and 20*b*, depending on the relative additional support desired for each fluid-filled chamber.

Figure 2:
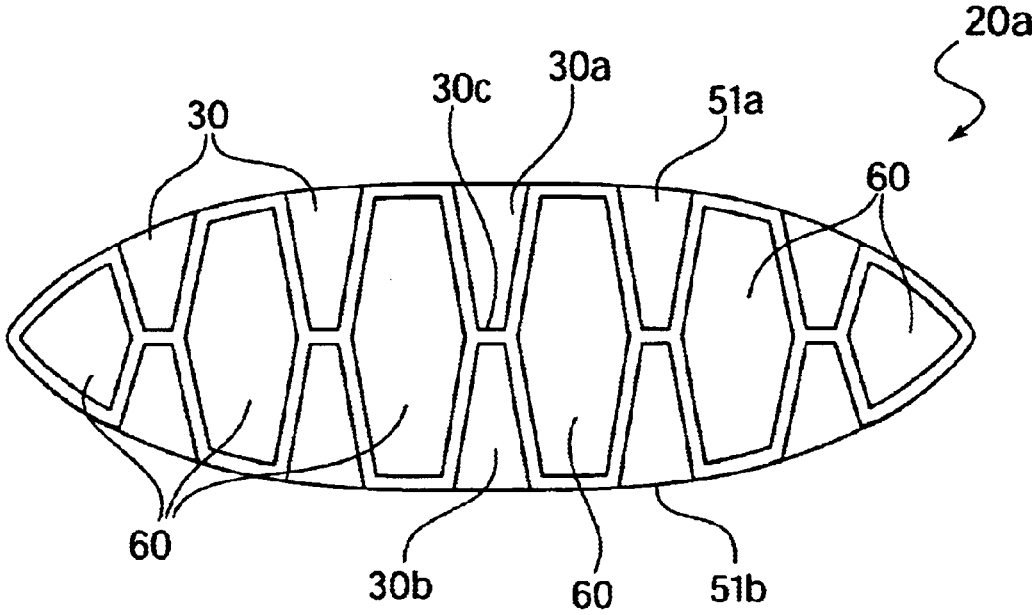
FIG. 2 is a cross-sectional view of the pillar-supported fluid-filled chamber of the present invention, taken along lines' 2—2 of FIG. 1.
Figure 3:
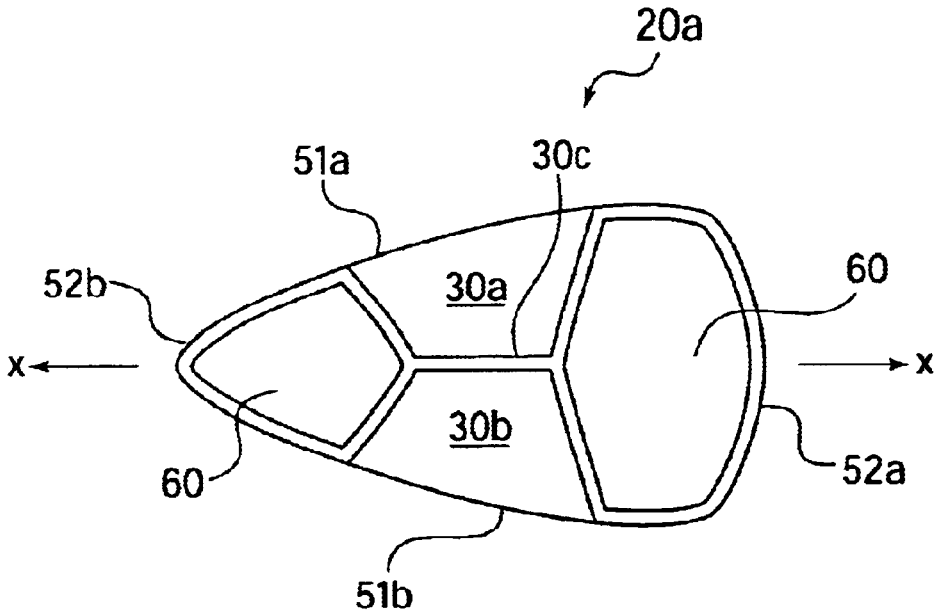
FIG. 3 is a cross-sectional view of the pillar-supported fluid-filled chambers of the present invention, taken along lines 3—3 of FIG. 1.

Additional views of the pillars 30, according to the example embodiment shown in FIG. 1, are illustrated in FIGS. 2 and 3. More specifically, FIG. 2 is a cross-sectional view of the bladder arrangement having pillar-supported fluid-filled chambers shown in FIG. 1 taken along lines 2—2. FIG. 3 is a cross-sectional view of the bladder arrangement having pillar-supported fluid-filled chambers shown in FIG. 1 taken along lines 3—3. Although it is contemplated that any shape of pillars 30 may be employed, FIG. 2 shows a preferred embodiment in which pillars 30 have the shape of hollow cleats 30*a* and 30*b*, a top hollow cleat 30*a* extending downwardly from a top surface 51*a* of the fluid-filled chamber 20*a* and a bottom hollow cleat 30*b* extending upwardly from a bottom surface 51*b* of the fluid-filled chamber 20*a*. The two hollow cleats 30*a* and 30*b* are joined at an interior wall 30*c*.

As illustrated in FIGS. 2 and 3, each hollow cleat 30*a* and 30*b* has a wider diameter at its intersection with the outer wall of the fluid-filled chamber, relative to its diameter at the interior wall 30*c*. For instance, the top hollow cleat 30*a* tapers from its widest diameter at the top surface 51*a* of the fluid-filled chamber 20*a* to its smallest diameter at the interior wall 30*c*. Likewise, the bottom hollow cleat 30*b* tapers from its widest diameter at the bottom surface 51*a* of the fluid-filled chamber 20*a* to its smallest diameter at the interior wall 30*c*. Although a single hollow cleat, which extends from the top surface 51*a* to the bottom surface 51*b* of the fluid-filled chamber 20*a*, may be employed, the tapered cleat configuration illustrated in FIGS. 2 and 3 provides improved structural rigidity. It is also noted that, while a hollow cleat is illustrated in FIGS. 1 through 3, a solid cleat may be employed instead.

As mentioned above, FIG. 3 is a cross-sectional view of the pillar-supported fluid-filled chamber 20*a* taken along lines 3—3 of FIG. 1. According to the example embodiment shown, the shape of each fluid-filled chamber 20*a* and 20*b* is tapered so as to provide a maximal height at the outermost regions of the wearer's foot. For instance, FIG. 3 illustrates fluid-filled chamber 20*a* having an outer region 52*a* and an inner region 52*b*. If the fluid-filled chamber 20*a* is incorporated in a shoe intended to be worn on the right foot of a wearer (as shown in FIG. 5), the outer region 52*a* of the fluid-filled chamber 20*a* is intended to support the lateral side of the wearer's foot. Thus, the outer region 52*a* of the fluid-filled chamber 20*a* provides the maximal height at the lateral side 110*a* of the heel region of the shoe 110. Likewise, FIG. 5 also shows fluid-filled chamber 20*b* having an outer region 53*a* and 53*b*. The outer region 53*a* of the fluid-filled chamber 20*b* is intended to support the medial side of the wearer's foot. Thus, the outer region 52*b* of the fluid-filled chamber 20*b* provides the maximal height at the medial side 110*b* of the heel region of the shoe 110. In addition, each fluid-filled chamber 20*a* and 20*b* is shown in the example embodiment to be tapered so as to have opposing convex outer sides.

It is noted that, while the accompanying figures illustrate the pillars 30 disposed within fluid-filled chambers having the shape of the fluid-filled chambers 20*a* and 20*b*, the pillars 30 of the present invention, in accordance with various other embodiments thereof, may be employed in fluid-filled chambers having other shapes. For instance, fluid-filled chambers having alternative shapes are shown and described in Applicants' co-pending U.S. patent application Ser. No. 09/897,631 and U.S. Provisional Patent Application Serial No. 60/226,451, and it is appreciated that the pillars 30 described herein may be employed in fluid-filled chambers such as those shown and described in those application, or else may be employed in fluid-filled chambers having any conceivable size and shape. As such, the present invention is not intended to be limited by the size or shape of the fluid-filled chamber in which the pillars are disposed.

Figure 4:
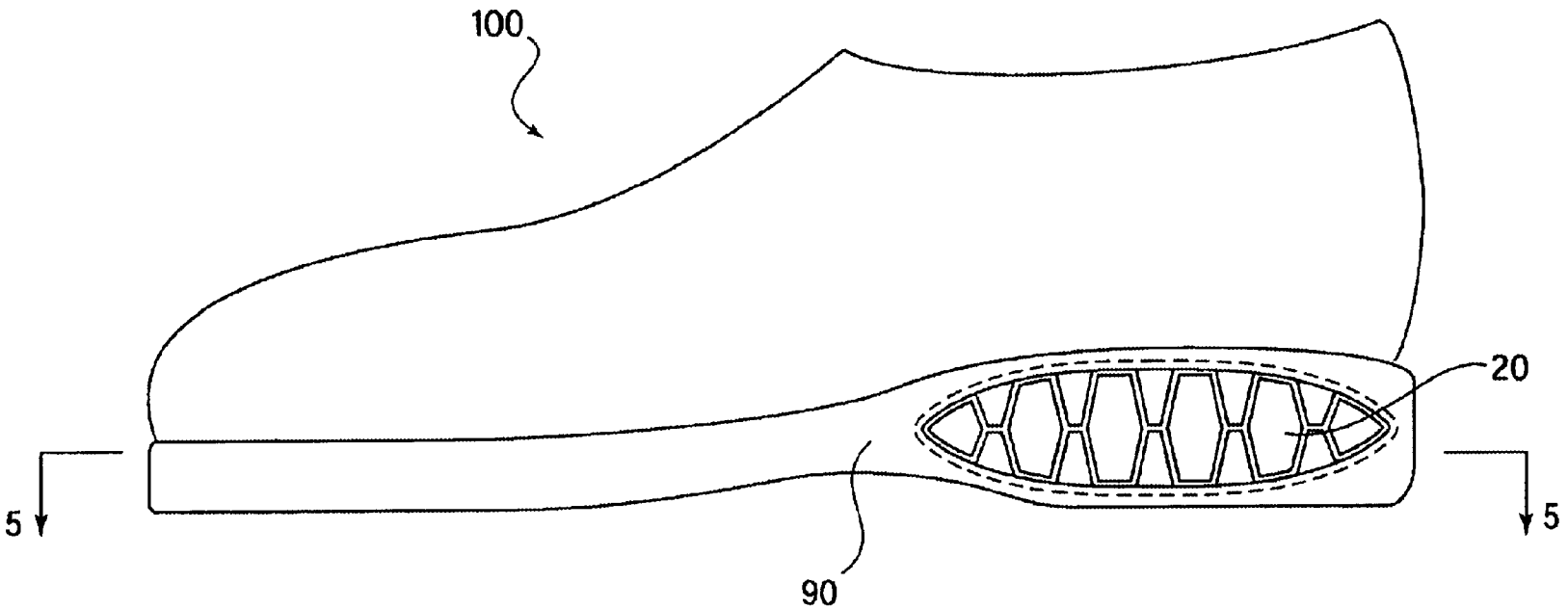
FIG. 4 is a side view of the pillar-supported fluid-filled chamber illustrated in FIGS. 1–3, positioned in a shoe.
Figure 5:
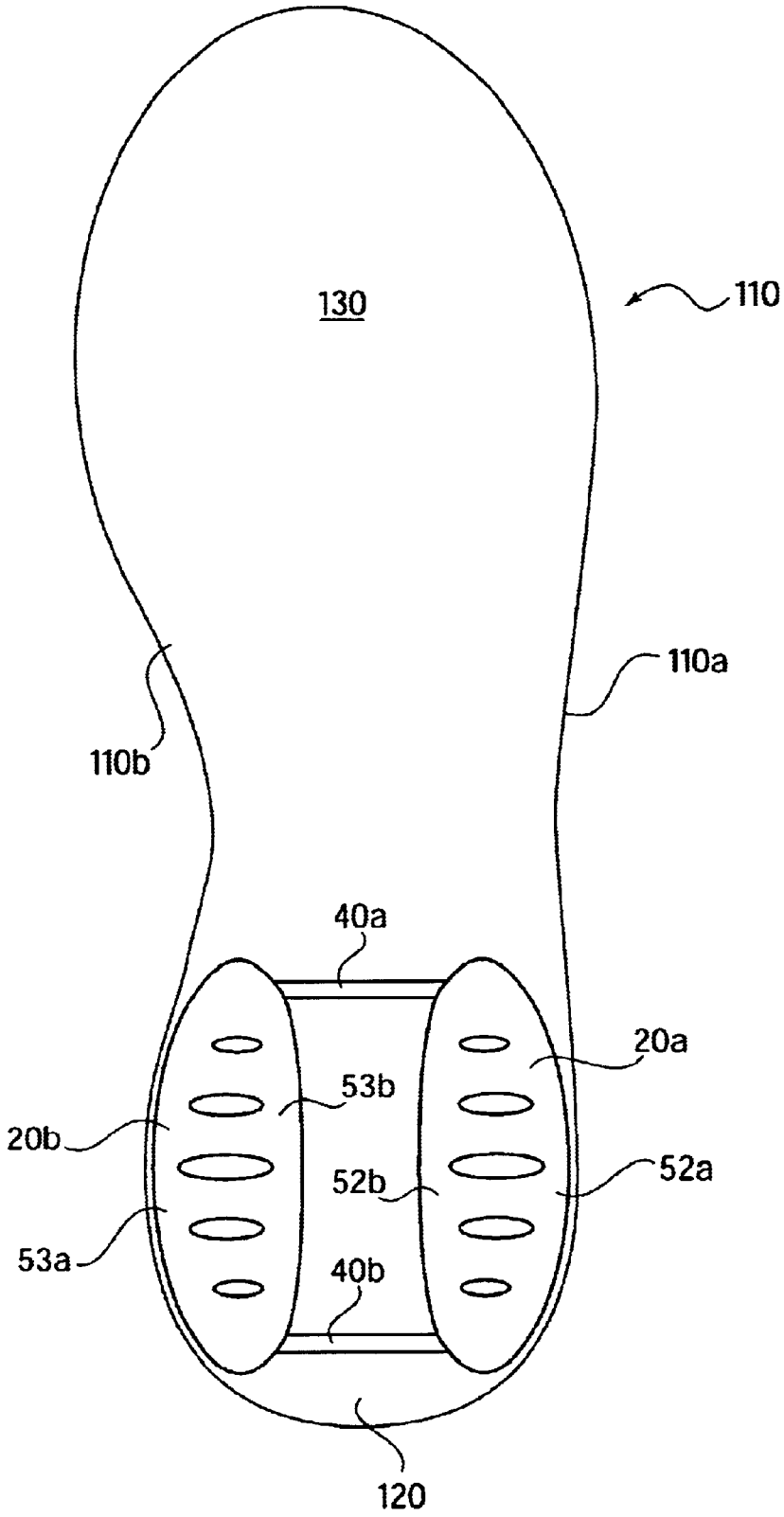
FIG. 5 is a top cross-sectional view of the bladder arrangement having pillar-supported fluid-filled chambers, positioned in a shoe, and taken along the lines 5—5 of FIG. 4.

Referring now to FIGS. 4 and 5, FIG. 4 is a side view of the support structure 10 illustrated in FIGS. 1 through 3, positioned in a shoe 110, in accordance with one example embodiment of the invention. FIG. 5 is a top cross-sectional view of the bladder arrangement of the support structure 10 positioned in the shoe 110, taken along the lines 5—5 of FIG. 4. More specifically, in FIG. 4, the bladder arrangement of the support structure 10 is shown encapsulated within a layer of an elastomeric material 90 in order to provide increased cushioning directly under the heel of the wearer and to maintain the support structure 10 in position under the wearer's heel. The preferred thickness and other characteristics of the encapsulation layer 90 are dependent on a number of variables such as the pressure within each of the fluid-filled chambers 20*a* and 20*b* to be encapsulated, the wall thickness of the fluid-filled chambers, the hardness of the outer wall material of the fluid-filled chambers, etc. It is also noted that the support structure 10 may be either partially encapsulated (as shown) or not encapsulated at all.

A preferred material for the encapsulation layer 90 is polyurethane foam. However, various other elastomeric materials may be used to encapsulate the support structure 10. Other materials include, by way of non-limiting example, EVA, polyester, polyvinyl chloride, neoprene, polyethylene, and rubber. In addition to absorbing the force of the initial impact, the layer of elastomeric material 90 foam absorbs the residual impact forces arising when the fluid-filled chambers 20*a* and 20*b* have been deformed. The encapsulation layer 90 is designed to have desirable cushioning and recovery properties.

It is noted that, while the support structure 10 is shown in FIGS. 4 and 5 as being positioned at the heel of the shoe 110, the support structure 10 may also be positioned, according to various other alternative example embodiments of the present invention, at various other locations within the shoe to provide support and cushioning at these other locations. In addition, it is noted that the support structure 10 may be incorporated directly into the shoe 110 during manufacturing or it may be a supplemental component, added or removed from the shoe 110 at a different point in the shoe assembly process.

FIGS. 1 through 5 illustrate the fluid-filled chambers 20*a* and 20*b* as being similar in size and as having symmetrical, e.g., mirror-image, shapes which are tapered to have a maximum thickness profile in a middle region and to have a lesser thickness profile at their end regions. It is recognized that, in accordance with alternative example embodiments of the present invention, the fluid-filled chambers 20*a* and 20*b* may have different sizes relative to each other. However, the example embodiment shown provides the advantage that the support structure 10 may be employed in either a right or left shoe, thus preventing manufacturing errors. Similarly, while FIG. 3 illustrates each of the fluid-filled chambers 20*a* and 20*b* as being approximately symmetrical about a central x-axis, it is recognized that, in accordance with alternative example embodiments of the present invention, each of the fluid-filled chambers 20*a* and 20*b* may be unsymmetrical about the central x-axis. However, the example embodiment shown provides the advantage that the support structure 10 will provide the same support and cushioning even if it is flipped over before being encapsulated in the sole of the shoe, thus further preventing manufacturing errors.

The features described above provide increased stabilization by resisting the undesired rotational movements of the wearer's foot relative to his or her leg. For instance, when an athlete changes his or her direction rapidly or when an athlete steps on an uneven playing surface, pressure may be exerted on the outside edge of the athlete's foot. This pressure on the outside of the athlete's foot may be translated, by way of example, to the outer region 52*a* of the fluid-filled chamber 20*a* which is supporting the lateral side 110*a* of the heel region of the shoe 110. The fluid-filled chamber 20*a*, which is designed to help absorb the impact forces which are experienced at the lateral side 110*a* of the heel region of the shoe 110, cushions the impact forces at this location and is deformed slightly by the pressure. However, if this pressure is too high, the outer region 52*a* of the fluid-filled chamber 20*a* may be deformed more substantially than desired, thereby causing the athlete's foot to undesirably rotate relative to his or her leg. In accordance with the example embodiment of the invention shown herein, the pillars 30 of the fluid-filled chambers 20*a* operate to decrease the amount by which the outer region 52*a* of the fluid-filled chambers 20*a* is compressively deformed, thereby decreasing the likelihood that the athlete's foot will undesirably rotate relative to his or her leg. Preferably, the pillars 30 are configured such that, although they decrease the amount by which the fluid-filled chamber is compressively deformed when the external pressure of the athlete's foot is applied thereto, they do permit the fluid-filled chambers to be deformed sufficiently to provide adequate protection against the forces of impact which are experienced by the athlete during use. In this way, the support structure 10 provides the cushioning benefits of a fluid-filled chamber without sacrificing the stability of the shoe.

In the foregoing description, the device of the invention has been described with reference to a preferred embodiment that is not to be considered limiting. Rather, it is to be understood and expected that variations in the principles of the device herein disclosed may be made by one skilled in the art and it is intended that such modifications, changes, and/or substitutions are to be included within the scope of the present invention as set forth in the appended claims. The specification and the drawings are accordingly to be regarded in an illustrative rather than in a restrictive sense and reference should be made to the claims rather than to the foregoing specification as indicating the scope thereof.

What is claimed is:

1. A support structure for a shoe comprising:

a bladder arrangement comprising a plurality of fluid-filled chambers and at least two connective elements connecting at least two of the plurality of fluid-filled chambers, wherein each of the plurality of fluid-filled chambers has outer walls with a fluid disposed therein and is configured to be compressively deformed when a pressure is applied thereto, and wherein the plurality of fluid-filled chambers are not in fluid communication with each other; and a pillar disposed in each of the plurality of fluid-filled chambers each of the pillars configured to decrease the amount by which each of the plurality of fluid-filled chambers is compressively deformed when the pressure is applied thereto.

2. The support structure of claim 1, further comprising a plurality of pillars are disposed in each of the plurality of fluid-filled chambers.

3. The support structure of claim 2, wherein each of the plurality of fluid-filled chambers have an equal number of pillars disposed therein.

4. The support structure of claim 2, wherein each of the plurality of fluid-filled chambers have an unequal number of pillars disposed therein.

5. The support structure of claim 1, wherein each of the pillars are tapered.

6. The support structure of claim 5, wherein each of the pillars are comprised of a pair of oppositely-disposed cleats, wherein each cleat tapers from a first dimension at a connection to the outer walls of each of the plurality of fluid-filled chambers to a second dimension at a point where the pair of cleats meet between the outer walls of each of the plurality of fluid-filled chambers wherein the first dimension is greater than the second dimension.

7. The support structure of claim 1, wherein the plurality of fluid-filled chambers comprises two fluid-filled chambers.

8. The support structure of claim 7, wherein the two fluid-filled chambers are pressurized to the same pressure levels.

9. The support structure of claim 7, wherein the two fluid-filled chambers are pressurized to different pressure levels.

10. The support structure of claim 7, wherein the two fluid-filled chambers are symmetrically shaped.

11. The support structure of claim 7, wherein the two fluid-filled chambers each include a pair of opposing convex sides.

12. The support structure of claim 1, wherein the outer walls of each of the plurality of fluid-filled chambers are comprised of a material selected from the group consisting of thermoplastic polyurethane elastomer, polyester, poly (ethylene-co-vinyl acetate), polyethylene, propylene, neoprene and rubber.

13. The support structure of claim 1, wherein each of the plurality of fluid-filled chambers is at least partially encapsulated with a layer of elastomeric material.

14. The support structure of claim 13, wherein the layer of elastomeric material is selected from the group consisting of EVA, polyurethane, polyester, polyvinyl chloride, neoprene, polyethylene, and rubber.

15. The support structure of claim 1, wherein the fluid disposed within each of the plurality of fluid-filled chambers is selected from the group consisting of nitrogen gas, air, hexafluorethane, sulfur hexafluoride, liquid, gel and polymeric foam.

16. The support structure of claim 1, wherein the fluid disposed within each of the plurality of fluid-filled chambers is pressurized.

17. The support structure of claim 16, wherein the fluid disposed within each of the plurality of fluid-filled chambers is pressurized to 15 pounds per square inch.

18. The support structure of claim 1, wherein the outer walls of each of the plurality of fluid-filled chambers have a thickness of approximately 1.2 mm.

19. The support structure of claim 1, wherein each of the plurality of fluid-filled chambers is tapered so as to provide a minimal height at an inner region and a maximal height at an outer region.

20. The support structure of claim 19, wherein the outer region of each of the plurality of fluid-filled chambers corresponds to the position of an outer edge of a wearer's foot.

* * * * *